US006502784B1

(12) United States Patent
Sato

(10) Patent No.: US 6,502,784 B1
(45) Date of Patent: Jan. 7, 2003

(54) DEVICE FOR DETECTING REMAINING QUANTITY OF ROLLED PAPERS

(75) Inventor: Hitoshi Sato, Tokyo (JP)

(73) Assignee: Japan CBM Corporation, Tokyo (JP)

( * ) Notice: Subject to any disclaimer, the term of this patent is extended or adjusted under 35 U.S.C. 154(b) by 41 days.

(21) Appl. No.: 09/599,830

(22) Filed: Jun. 23, 2000

(30) Foreign Application Priority Data

Jun. 25, 1999 (JP) ..... 11-180960

(51) Int. Cl.[7] ..... B65H 26/00; B65H 26/06; B65H 63/08

(52) U.S. Cl. ..... 242/563; 242/563.2; 242/348; 242/348.4; 242/595

(58) Field of Search ..... 242/563, 563.2, 242/595, 348, 348.4

(56) References Cited

U.S. PATENT DOCUMENTS 5,713,678 A * 2/1998 Smith et al. ..... 400/613

* cited by examiner

*Primary Examiner*—Donald P. Walsh
*Assistant Examiner*—Jonathan R. Miller
(74) *Attorney, Agent, or Firm*—Birch, Stewart, Kolasch & Birch, LLP

(57) ABSTRACT

A device for detecting remaining quantity of rolled papers has housing having a bottom for supporting a rolled paper. Optical detectors are provided for detecting a peripheral position of the rolled paper supported on the bottom when the peripheral position approaches an inner end of the paper and for generating an output signal. A positioning lever is provided for positioning the detectors at a position dependent on a radius of a core of the rolled paper. A control circuit responds to the output signal for informing that the rolled paper reaches the inner end.

3 Claims, 8 Drawing Sheets

DEVICE FOR DETECTING REMAINING QUANTITY OF ROLLED PAPERS

BACKGROUND OF THE INVENTION

The present invention relates to a device for detecting remaining quantity of rolled papers in a device such as a printer.

In such a device using the rolled paper as the printer, it is necessary to be informed that the remaining quantity of the rolled paper is little, even if a rolled paper different from a previously used rolled paper in diameter of the core is used.

In a conventional detecting device, a detecting plate for operating a detector switch must be moved in accordance with the change of the diameter of the core of the rolled paper. In order to move the detecting plate, a fixing screw is released, the detecting plate is moved along a guide, and the screw must be turned to fasten the plate. Therefore, the adjusting operation is troublesome.

SUMMARY OF THE INVENTION

An object of the present invention is to provide a detecting device which may be easily adjusted in accordance with the change of the diameter of the core.

According to the present invention, there is provided a device for detecting remaining quantity of rolled papers comprising, a housing having a bottom for supporting a rolled paper, detector means for detecting a peripheral position of the rolled paper supported on the bottom when the peripheral position approaches an inner end of the paper and for generating an output signal, positioning means for positioning the detector means at a position dependent on a radius of a core of the rolled paper, a control circuit responsive to the output signal for informing that the rolled paper reaches the inner end.

The detector means is at least one photodetector mounted on a rotatable lever, and the positioning means is notches provided in the housing and a movable knob having a lug engaged with one of the notches.

The photodetector comprises a light emitting element for emitting light to a side of the rolled paper, and a light receiving element for receiving the light reflected from the side.

These and other objects and features of the present invention will become more apparent from the following detailed description with reference to the accompanying drawings.

DETAILED DESCRIPTION OF THE PREFERRED EMBODIMENT

Figure 1:
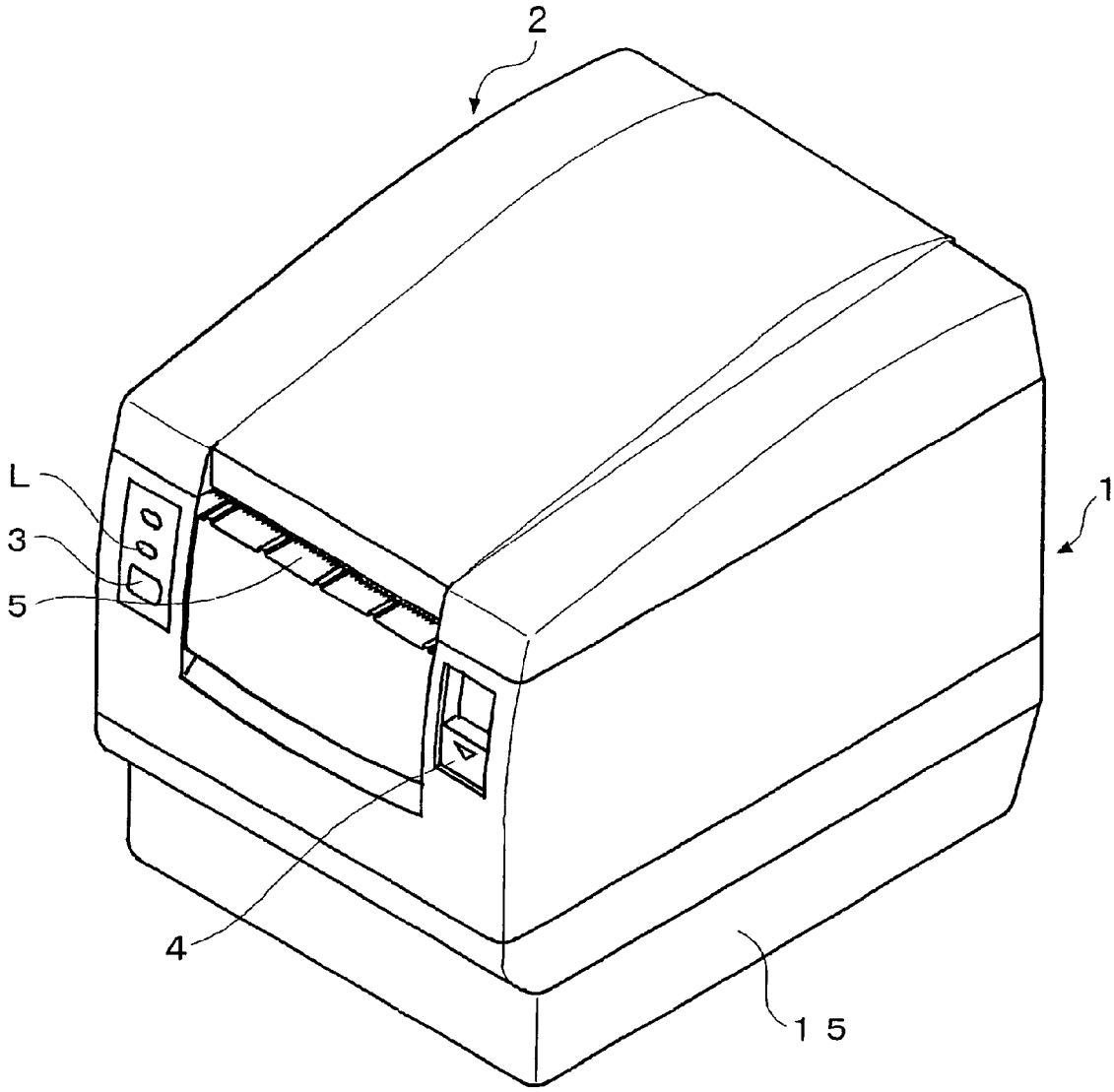
FIG. 1 is a perspective view showing a printer in which a detecting device of the present invention is provided.

Referring to FIG. 1 showing a perspective view of a printer in which a device of the present invention is mounted, the printer comprises a housing 1, cover 2 and a bottom case in which an AC adapter 16 (FIG. 3) is mounted. There is provided a paper feeding switch 3, a warning lamp L, a cover lock release button 4, and a paper discharge opening 5 on the front panel of the printer.

Figure 2:
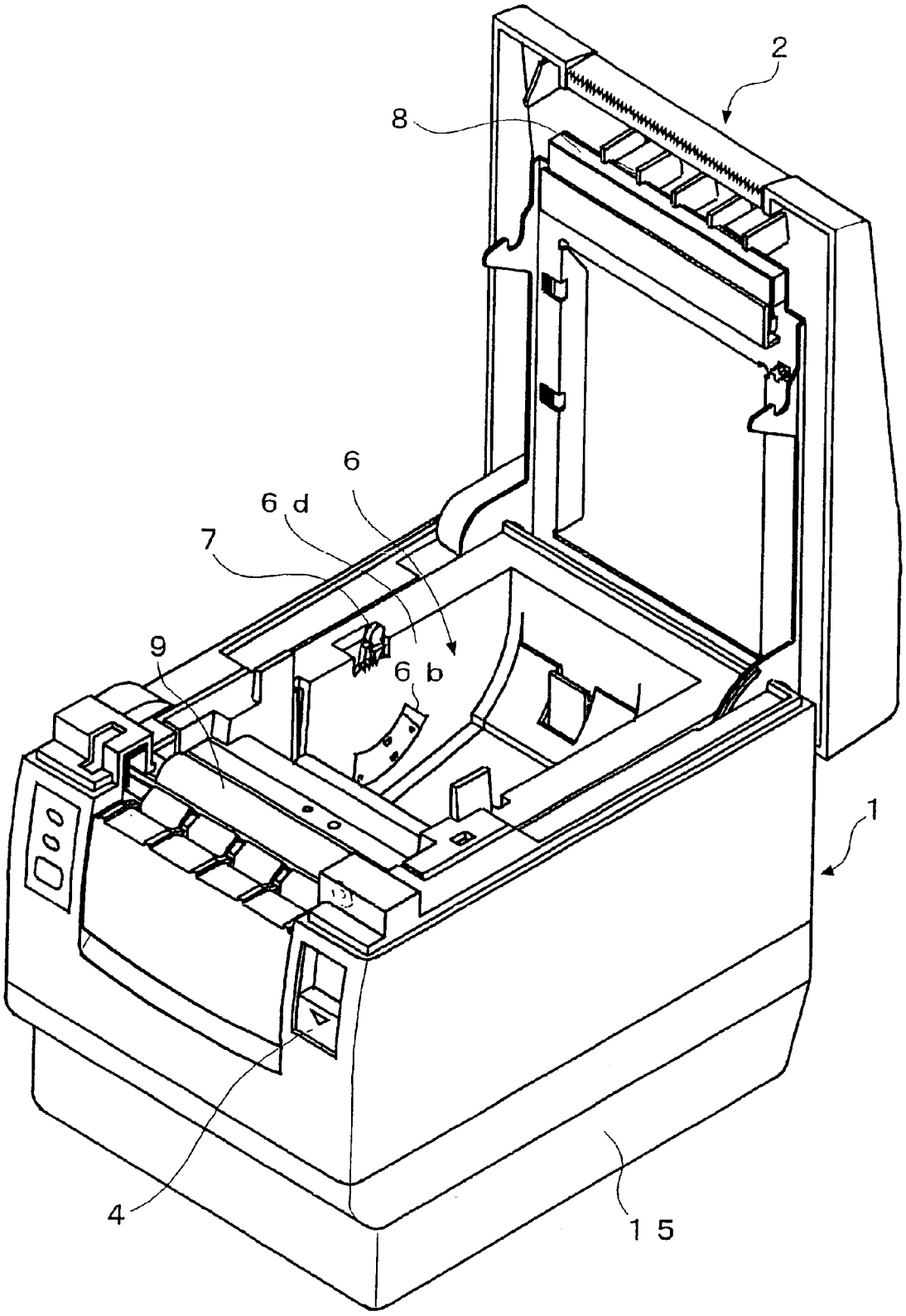
FIG. 2 is a perspective view of the printer when a cover is opened.
Figure 3:
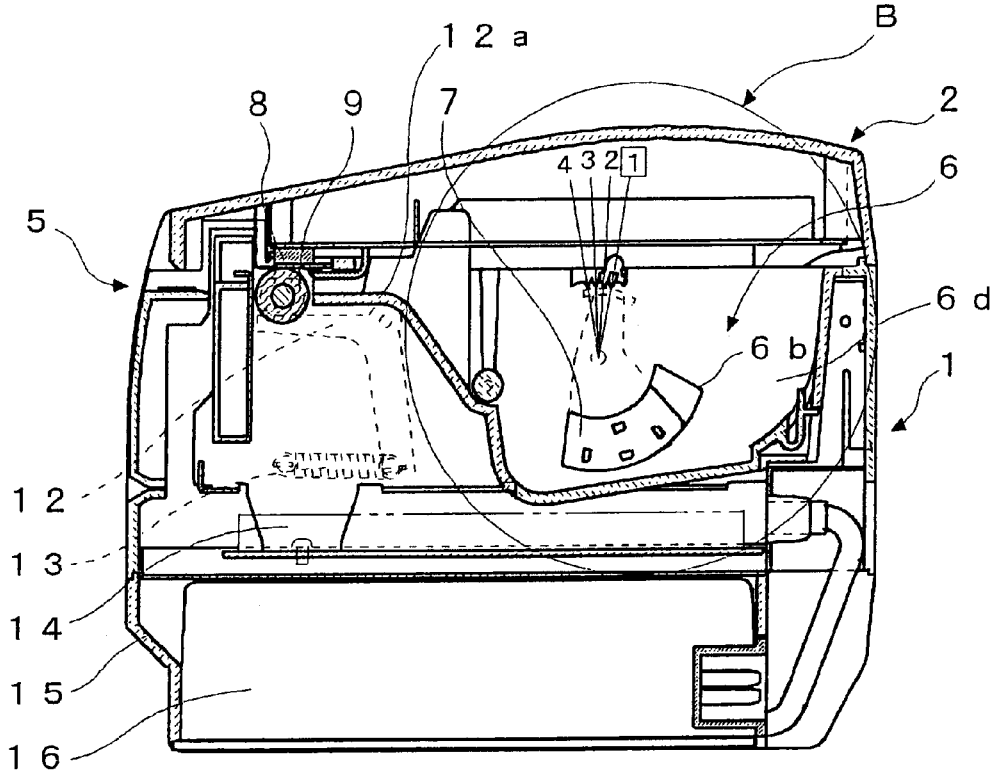
FIG. 3 is a sectional side view of the printer.

Referring to FIGS. 2 and 3, in the housing 1, a rolled paper housing space 6 is provided and a platen 9 is vertically slidably mounted. A platen push lever 12 is rotatably mounted by a shaft 12*a* and urged to the platen 9 by a spring 13 so as to press the platen to a print head 8 mounted in the cover 2. In a side wall 6*d* of the rolled paper housing space 6, an opening 6*b* having a sector shape is formed. In the opening 6*b*, a part of a remaining quantity detector lever 7 is exposed.

Figure 5A:
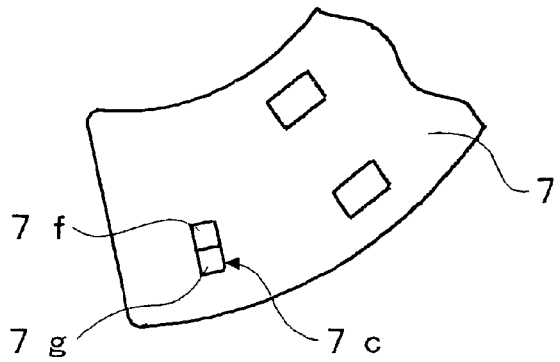
FIG. 5*a* is an enlarged view of a part of FIG. 5.
Figure 4:
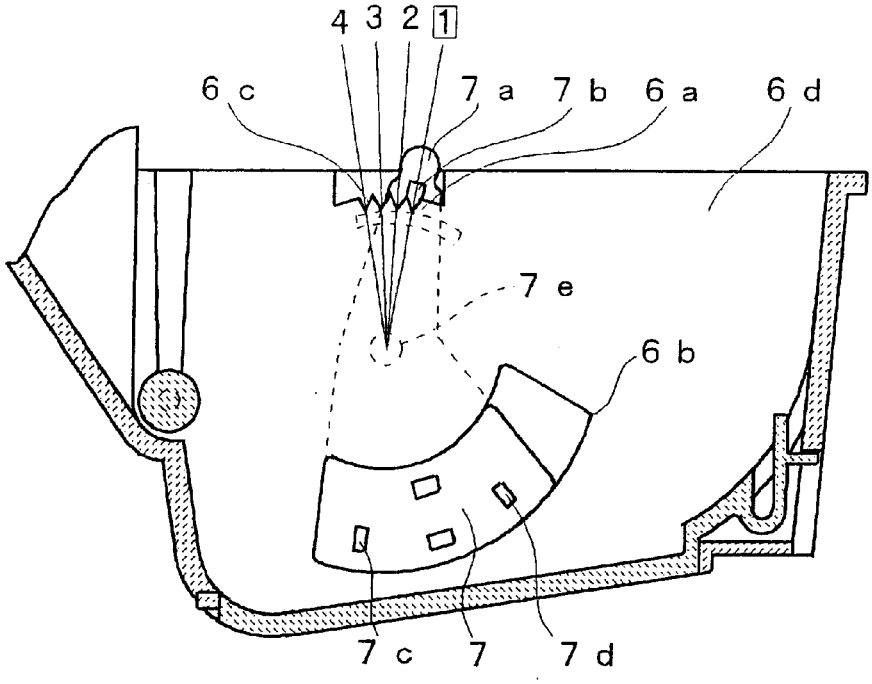
FIGS. 4 and 5 are enlarged views in a circle B of FIG. 3.
Figure 5:
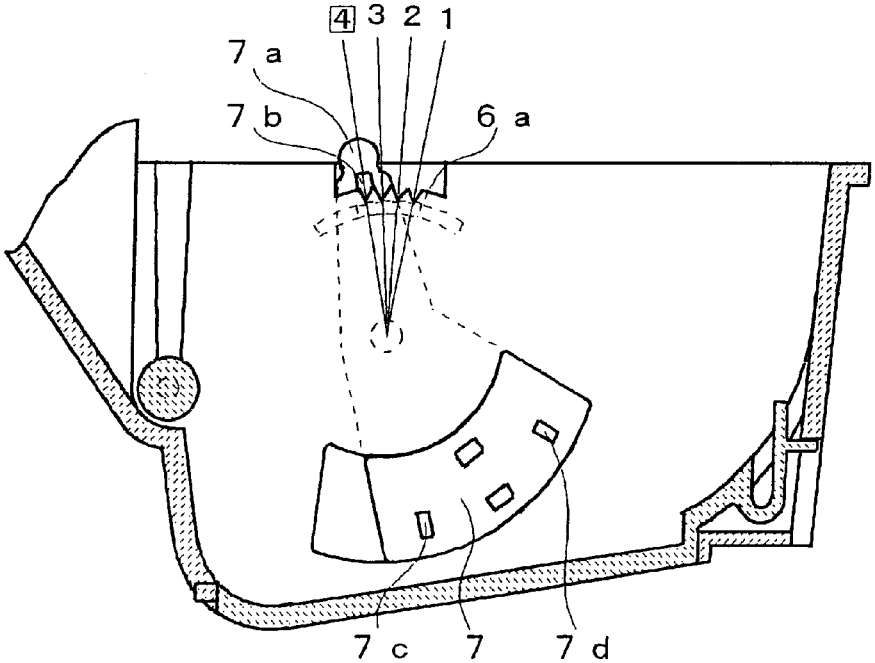

Referring to FIGS. 4, 5 and 5*a*, the lever 7 is pivotaly mounted on the side wall 6*d* by a shaft 7*e*. On the top of the lever 7, a knob 7*a* and an engaging lug 7*b* are formed. A recess 6*a* is formed in the side wall and four notches 6*c* are formed on the bottom of the recess 6*a*. The bottom 6*a* is arced, having the radius from the shaft 7*e*.

On the exposed part of the lever 7, a paper detecting first device 7*c* and a paper detecting second device 7*d* are provided. Each of the first and second devices 7*c* and 7*d* comprises a light emitting element 7*f* and light receiving element 7*g*.

The lever 7 is made of a thin plastic plate so that the upper portion of the lever 7 than the shaft 7*e* can be bent by pushing the knob 7*a* so as to be removed from the side wall 6*d*.

By bending the lever 7, the lug 7*b* is removed from the notch 6*c* so that the lever can be pivoted about the shaft 7*e*. Thus, the lug 7*b* can be engaged with a desired notch.

Figure 6:
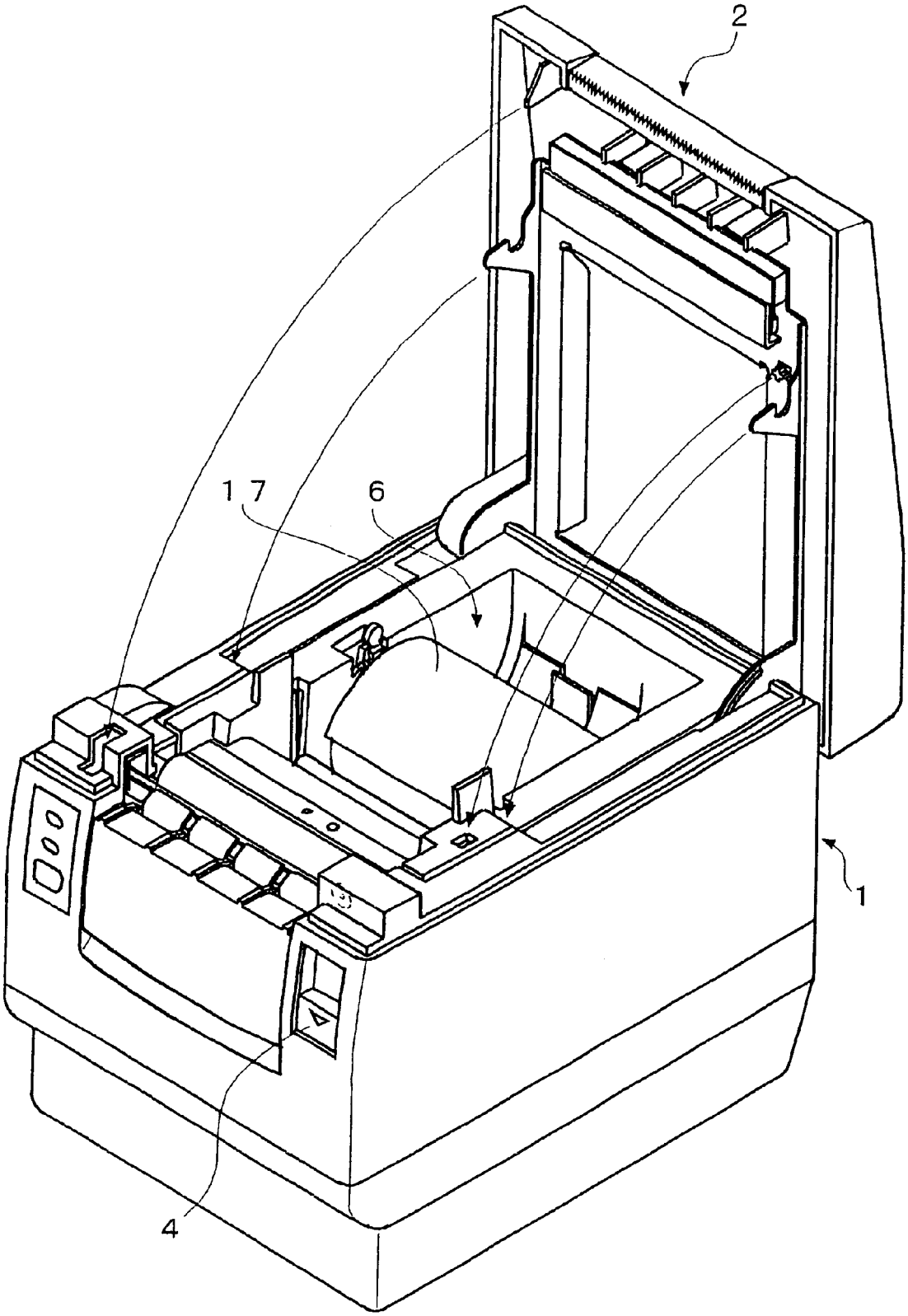
FIG. 6 is a perspective view showing a state wherein a rolled paper is mounted.
Figure 7:
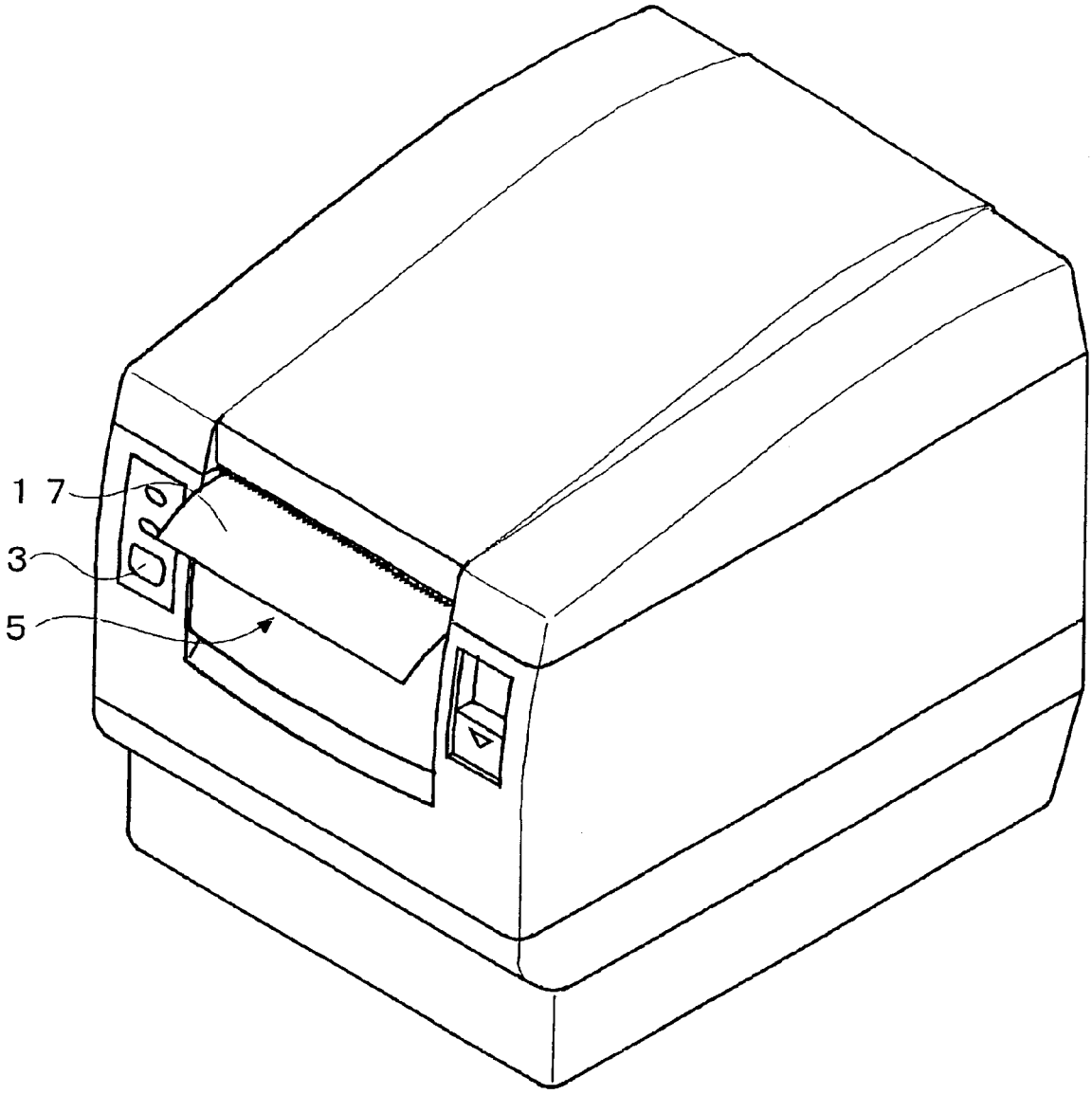
FIG. 7 is a perspective view showing an operating state of the printer.
Figure 8:
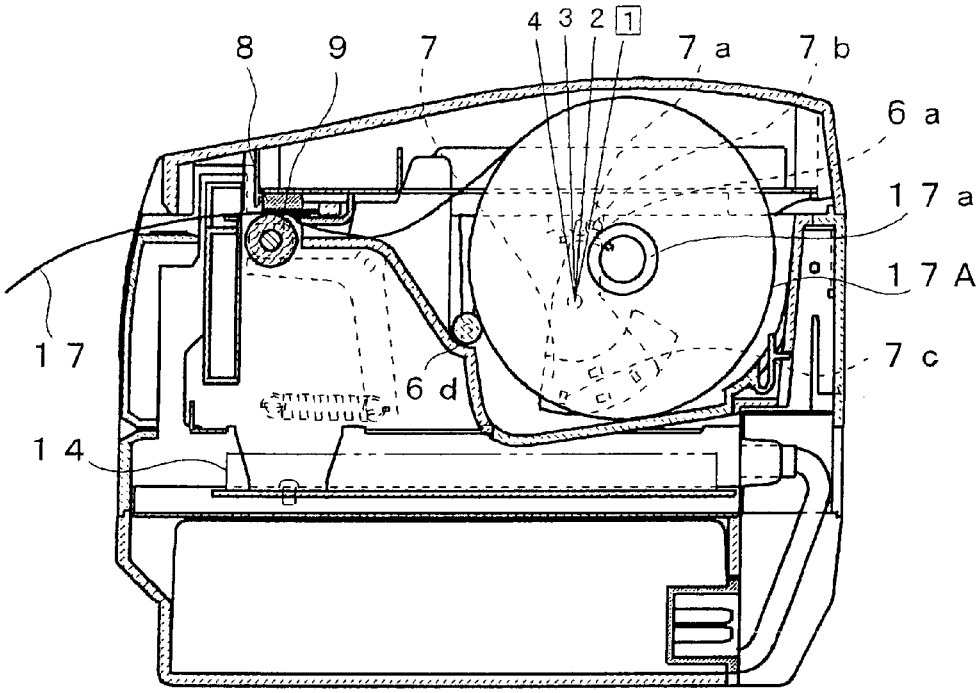
FIGS. 8 to 11 are sectional side views for explaining detecting operations

Referring to FIG. 6, a rolled paper 17 is mounted in the space 6. The rolled paper 17 is rotatably supported on the bottom of the space 6 and held by a lateral rod 6*d* as shown in FIG. 8. The end of the paper in FIG. 6 is pulled out of the housing 1 and the cover 2 is closed. As shown in FIG. 8, the paper is nipped between the platen 9 and the print head 8.

Figure 9:
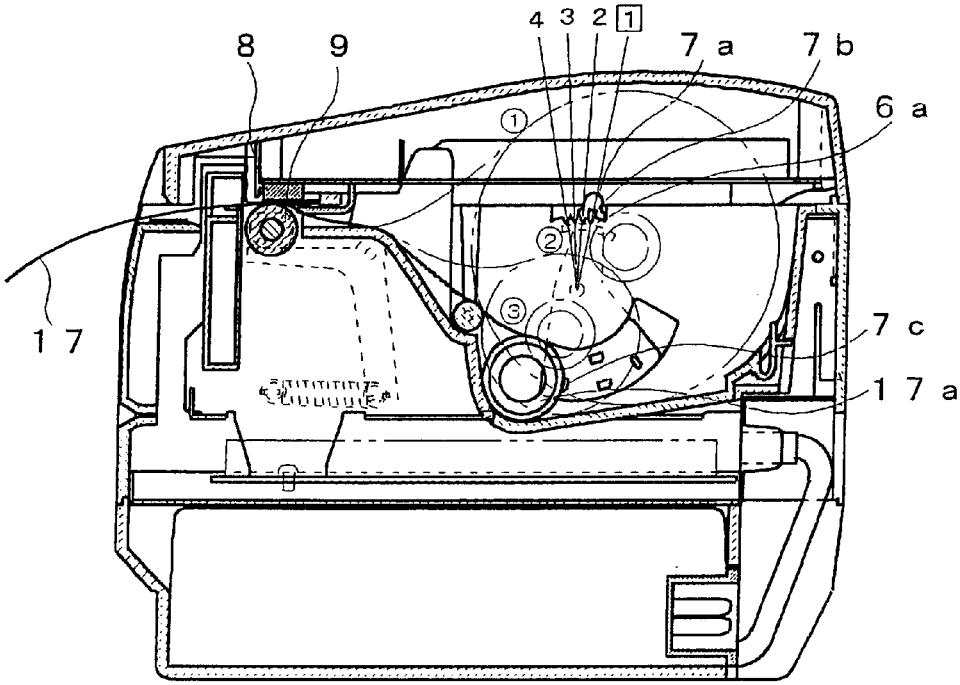

FIGS. 8 and 9 show a remaining quantity detecting operation of a rolled paper 17A having the smallest diameter core 17*a*. In the case of the smallest diameter core 17*a*, the lug 7*b* is engaged with a first notch (1) so that the paper detecting first device 7*c* is positioned at a left end position as shown in FIG. 8. The first device 7*c* is connected to a control circuit 14 by manually operating a changeover switch provided in the control circuit 14.

While sufficient amount paper exists, the light emitted from the light emitting element 7*f* is reflected from the side of the paper 17A and received by the light receiving element 7*g*. The light receiving element 7*g* produces an output signal which is applied to the control circuit 14. In such a condition, the control circuit 14 does not generate an end signal.

When the remaining quantity of the rolled paper 17A approaches the end of paper, the surface of the rolled paper leaves from the first device 7*c* as shown in FIG. 9. As a result, the light emitted from the light emitting element does not reflect from the side of the rolled paper. Thus, the light receiving element 7*g* does not produce the output signal. In response to the disappearance of the output signal, the control circuit 14 generates the end signal so that the warning lamp L is lighted and a buzzer (not shown) emits a warning sound.

Figure 10:
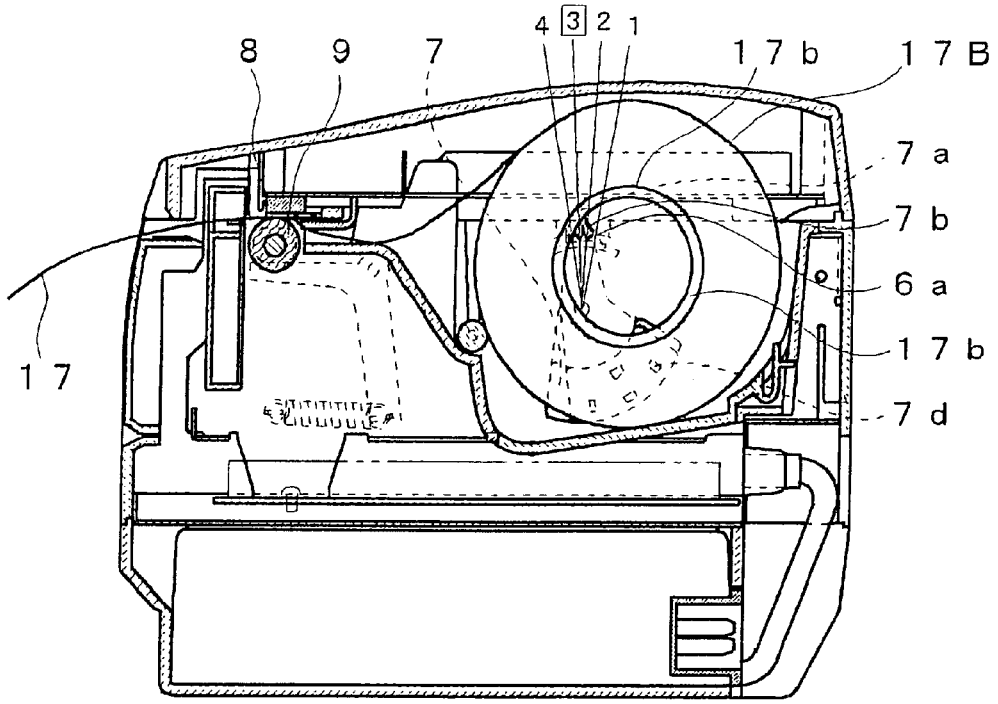
Figure 11:
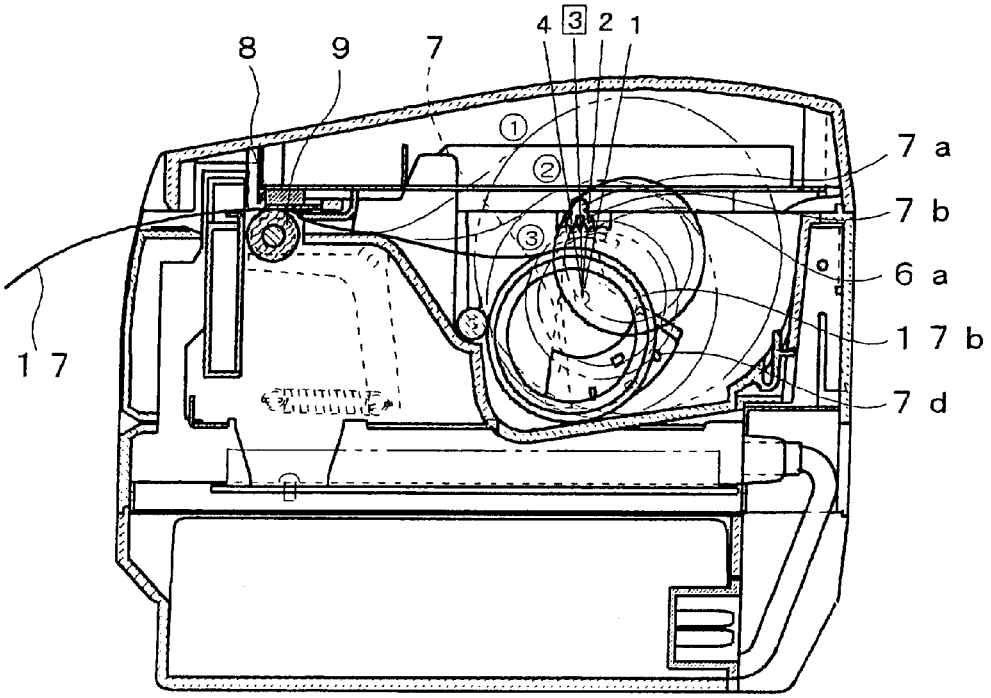

FIGS. 10 and 11 show a remaining quantity detecting operation of a rolled paper 17B having the largest diameter core 17*b*. In the case of the largest diameter core 17*a*, the lug 7*b* and the lever 7 is rotated in the counterclockwise direction in FIG. 4*a* and engaged with a fourth notch (4) so that the paper detecting second device 7*d* is positioned at a right end position as shown in FIG. 10. The second device 7*d* is connected to a control circuit 14 by operating the changeover switch.

In the condition of FIG. 10, the light emitted from the light emitting element is reflected from the side of the paper 17B and received by the light receiving element. The light receiving element produces the output signal which is applied to the control circuit 14. The control circuit 14 does not generate the end signal.

When the remaining quantity of the rolled paper 17B approaches the end of the paper, and the surface of the rolled paper leaves from the first device 7*d* (FIG. 11). The light receiving element does not produce the output signal. Thus, the control circuit generates the end signal so that the warning lamp L is lighted and buzzer is operated When a rolled paper having an intermediate diameter core, the second (2) or third (3) notch is selected.

In accordance with the present invention, the ends of rolled papers which are different in core diameter can be detected.

While the invention has been described in conjunction with preferred specific embodiment thereof, it will be understood that this description is intended to illustrate and not limit the scope of the invention, which is defined by the following claims.

What is claimed is:

1. A device for detecting a remaining quantity of rolled papers which are classified according to the diameter of a core of the rolled paper, the device comprising:

a housing having a bottom for supporting a rolled paper;

optical detector means provided to be moved along a line so that the position of the optical detector means changes in a radial direction of the rolled paper supported on the bottom when the optical detector means is moved;

the optical detector means being provided for generating an output signal dependent on existence of an axial side face of the rolled paper;

positioning means for positioning the optical detector means at a position dependent on the diameter of the core of the roller paper; and a control circuit for informing the end of the rolled paper in accordance with disappearance of the output signal dependent on nonexistence of the side face.

2. The device for detecting remaining quantity of rolled papers according to claim 1, wherein the detector means is at least one photodetector mounted on a rotatable lever, and the positioning means is a plurality of notches provided in the housing and a movable knob having a lug engaged with one of the notches.

3. The device for detecting remaining quantity of rolled papers according to claim 2, wherein the photodetector comprises a light emitting element for emitting light to the side face of the rolled paper, and a light receiving element for receiving the light reflected from the side face.

* * * * *